US005386909A

United States Patent [19]

Spector

[11] Patent Number: 5,386,909

[45] Date of Patent: Feb. 7, 1995

[54] DISPLAY PACKAGE FOR SHAPED CANDY PIECES

[76] Inventor: Donald Spector, 380 Mountain Rd., Union City, N.J. 07080

[21] Appl. No.: 144,347

[22] Filed: Nov. 1, 1993

[51] Int. Cl.[6] ..... B65D 73/00

[52] U.S. Cl. ..... 206/457; 206/45.31; 215/228; 446/73; D9/310

[58] Field of Search ..... 206/457, 45.31; 215/100 R, 227, 228; 220/376, 408, 903, 410, 411; 446/73, 76; D9/310-312; D7/628

[56] References Cited

U.S. PATENT DOCUMENTS

| | | | |
|---|---|---|---|
| D. 155,005 | 8/1949 | Graham | D9/312 |
| D. 162,710 | 4/1951 | Brazeau | D9/310 |
| D. 166,996 | 3/1952 | Rachins | D9/310 |
| 2,102,329 | 12/1937 | Nelson et al. | D9/310 X |
| 2,484,776 | 10/1949 | Zent et al. | 206/457 X |
| 2,485,816 | 10/1949 | Dalsemer | 220/411 X |
| 2,532,729 | 12/1950 | Millstein | 446/73 |
| 2,568,371 | 9/1951 | Seaver | 220/410 X |
| 2,632,576 | 3/1953 | Hassid et al. | 220/410 X |
| 3,660,926 | 5/1972 | Lerner et al. | 446/73 |
| 4,708,254 | 11/1987 | Byrns | 220/903 X |
| 5,059,149 | 10/1991 | Stone | 446/73 |
| 5,088,611 | 2/1992 | Katz | 215/227 X |

*Primary Examiner*—Paul T. Sewell
*Assistant Examiner*—Ted Kavanaugh
*Attorney, Agent, or Firm*—Michael Ebert

[57] ABSTRACT

A display package housing a cylindrical, transparent container on whose externally-threaded neck is received a screw-on cap, the container being loaded with shaped candy pieces having a figurative form such as that of a miniature bear. The package is constituted by a hollow plastic figure whose form is similar to that of the shaped candy piece, but in a greatly enlarged scale. The figure is divided into a body section and a complementary head section. The internal cavity of the body section communicates with a top end opening and with a front side viewing port. The internal cavity of the head section communicates with a bottom end opening within which is nested the container cap. The container is fixedly seated within the internal cavity of the body section, the container neck projecting above the top end opening whereby the head section having the cap nested therein may be screwed thereon to complete the figure, or unscrewed to provide access to the candy pieces in the container.

9 Claims, 2 Drawing Sheets

FIG. 1
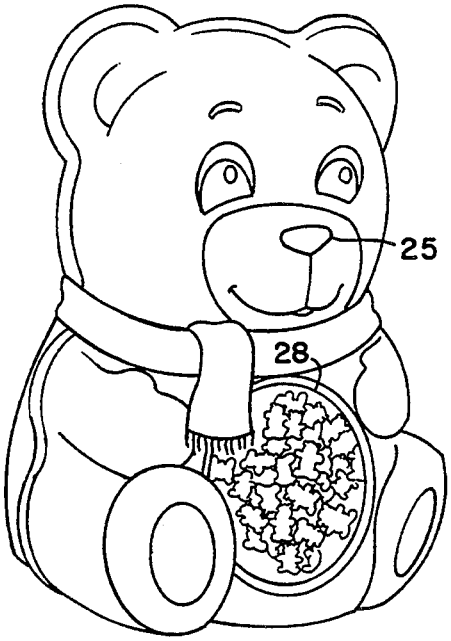
FIG. 3
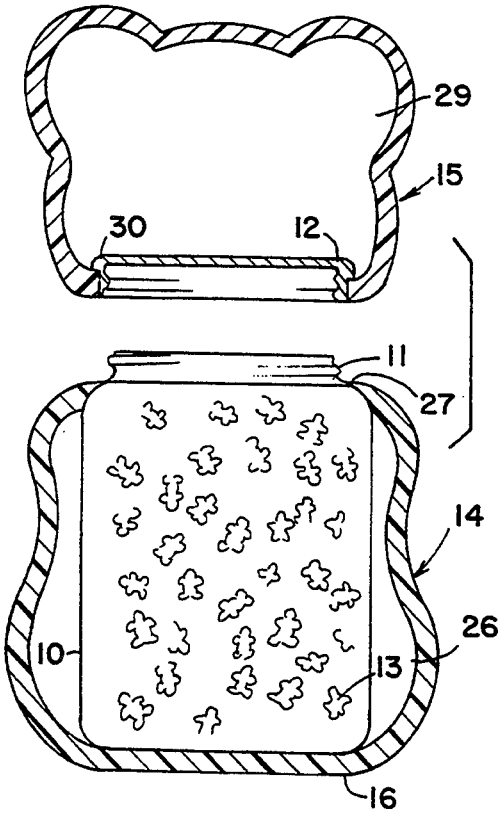
FIG. 4
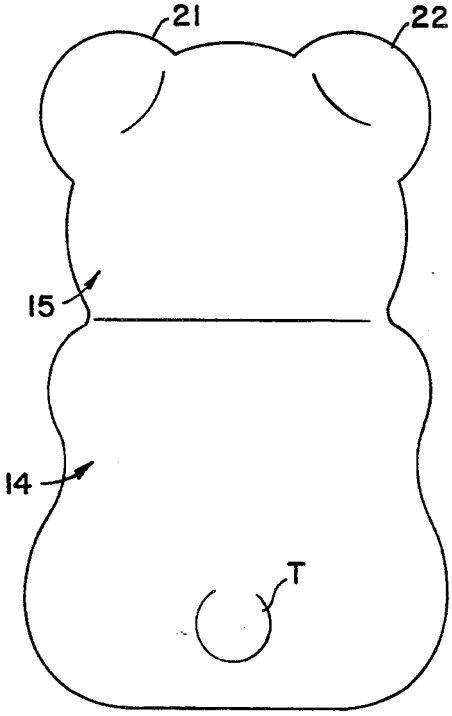
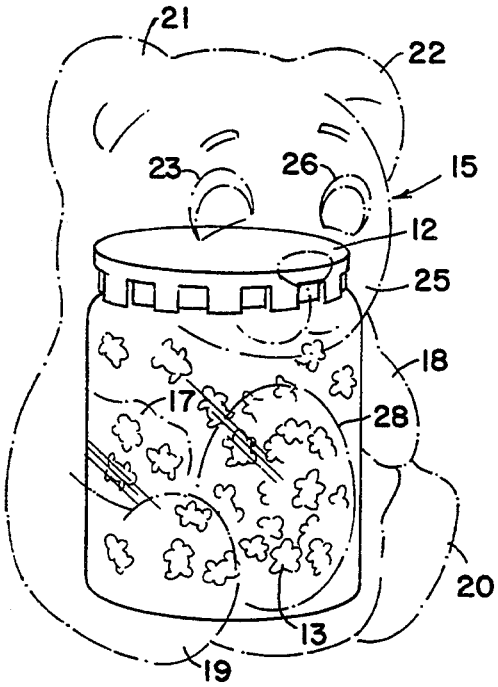
FIG. 2

FIG. 5
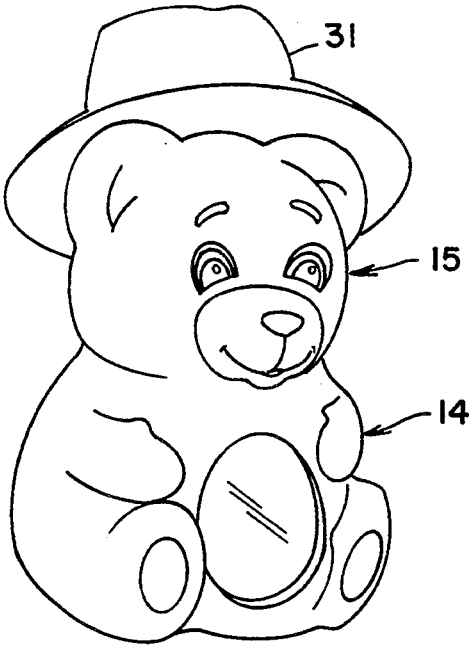
FIG. 6
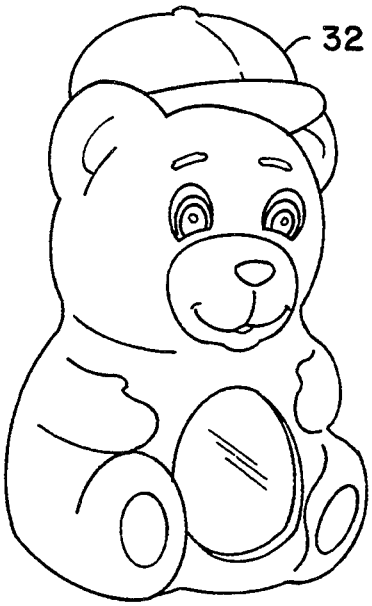
FIG. 7
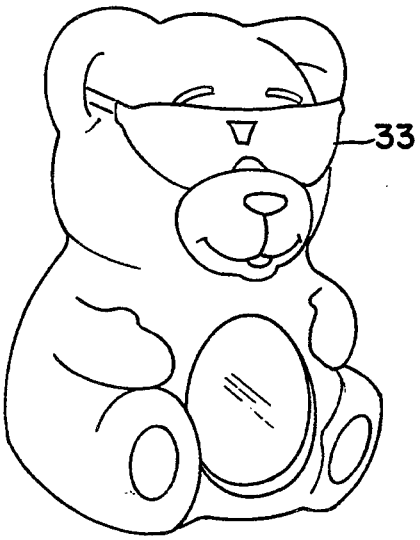
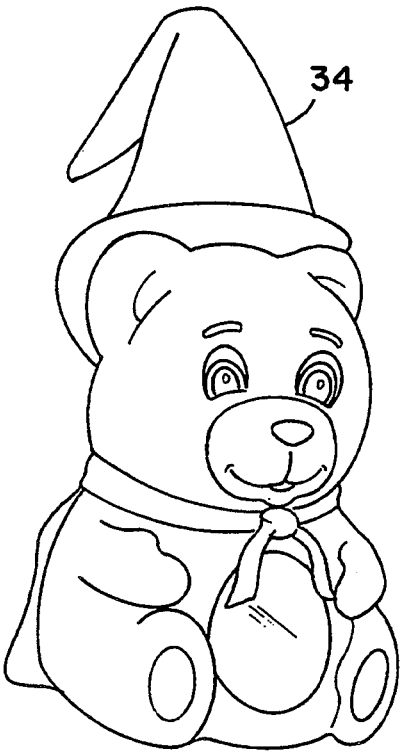
FIG. 8

DISPLAY PACKAGE FOR SHAPED CANDY PIECES

BACKGROUND OF INVENTION

1. Field of Invention

This invention relates generally to packages for candy pieces, and more particularly to a display package housing a container loaded with candy pieces all having the same figurative form, the package being generally in the shape of a candy piece, but in a greatly enlarged scale.

2. Status of Prior Art

In merchandising, it is a common practice to package candy and other edible products so as to create the impression that the package contains a larger quantity of the product than is actually contained therein. It is for the same reason that many toys are packaged in oversized boxes.

This is not done to deceive children, but to satisfy their desire for sheer bulk. The smaller the child, the greater his play interest in bigness. Also the larger the package, the greater is its display potential.

The present invention is concerned with candy pieces. These are often packaged in a transparent jar or container made of glass or transparent plastic material provided with a screw-on cap which seals the candy pieces loaded in the container so as to exclude contaminants and maintain the pieces in a sterile condition.

A conventional transparent container is not much larger than the load of candy pieces stored therein, and is generally utilitarian in appearance. Hence if a container of this type is put on display on the counter or shelf of a retail store, it does little to attract the attention of a potential purchaser. Moreover, the conventional container for candy pieces, when depleted of these pieces, is usually then discarded, for it has little visual appeal and the owner has no reason to retain it.

Should a manufacturer of candy pieces wish to enhance the attractiveness of the container for these pieces so that the container effectively displays his product, and he provided for this purpose a shaped container molded of synthetic plastic material having a figurative form, then he is faced with the problem of packaging the candy pieces under acceptable sanitary conditions.

Candy pieces are usually produced and packaged in a "clean room" in which the ambient atmosphere is filtered and the workers operate with gloved hands and wear sterile garments. But should the same facility include plastic molding equipment to make the containers which are thereafter filled with the candy pieces, it then becomes difficult to maintain the sterility of the edible product.

SUMMARY OF INVENTION

In view of the foregoing, the main object of the present invention is to provide a display package for a load of shaped candy pieces all having the same figurative form, the package having a similar shape but in a much greater scale.

More particularly, an object of this invention is to provide a display package formed by a body section and a complementary head section which when joined to the body section creates an animal-like or humanoid figure, the figure being hollow to accommodate a sealed container in which the candy pieces are stored.

A significant feature of the invention resides in a display package having bulbous body section provided with a front port to expose candy pieces stored in a transparent cylindrical container seated within the body section, this arrangement giving a viewer the impression that the entire package is filled with candy pieces.

Also an object of the invention is to provide a display package for candy pieces which is integrated with a transparent container for the pieces and the screw-on cap of the container, so that when the container is depleted of candy pieces, the package which has an attractive figurative form, may be retained as a decorative object and also used to store small pieces.

Yet another object of this invention is to provide a hollow plastic display package having a body section and a complementary head section which together define a figurative form, the package being adapted to accommodate in its interior a container loaded with candy pieces produced under sterile conditions and maintained in this condition by the screw-on cap which seals the container, the sealed container being integrated with the head and body sections under conditions which do not require a "clean room," for this operation will not expose the candy pieces to contaminants.

Briefly stated, these objects are attained in a display package housing a cylindrical, transparent container on whose externally-threaded neck is received a screw-on cap, the container being loaded with shaped candy pieces having a figurative form such as that of a miniature bear. The package is constituted by a hollow plastic figure whose form is similar to that of the shaped candy piece, but in a greatly enlarged scale. The figure is divided into a body section and a complementary head section. The internal cavity of the body section communicates with a top end opening and with a front side viewing port. The internal cavity of the head section communicates with a bottom end opening within which is nested the container cap. The container is fixedly seated within the internal cavity of the body section, the container neck projecting above the top end opening whereby the head section having the cap nested therein may be screwed thereon to complete the figure, or unscrewed to provide access to the candy pieces in the container.

BRIEF DESCRIPTION OF DRAWINGS

For a better understanding of the invention, as well as further features thereof, reference is made to the following description to be read in conjunction with the drawings wherein:

FIG. 1 is a front view, in perspective, of a hollow bear-shaped display package in accordance with a preferred embodiment of the invention;

FIG. 2 illustrates the same package, but shows in dotted lines the candy-loaded container housed within the package;

FIG. 3 is a section taken through the body and head sections of the package;

FIG. 4 is a rear view of the package;

FIG. 5 shows the package decorated to represent a cowboy bear;

FIG. 6 shows the package decorated to represent a baseball bear;

FIG. 7 illustrates a beach bear; and

FIG. 8 illustrates a Halloween bear.

DETAILED DESCRIPTION OF INVENTION

As shown in FIGS. 1 to 4 of the drawings, a display package in accordance with the invention includes a cylindrical container 10 having an externally-threaded neck 11 on which is receivable a screw-on cap 12. Container 10 which is fabricated of glass or of a transparent synthetic plastic material of high-strength, such as polypropylene or polyethylene, is loaded with candy pieces 13 in various colors. These are produced under sterile conditions which are maintained when cap 12 is screwed onto the container after it is loaded, thereby excluding contaminants from the sealed container.

In the embodiment illustrated herein, candy pieces 13 are molded of jelly in the shape of a miniature bear, such candy pieces being currently marketed under the trademark GUMMY BEAR. But the invention is not limited to these candy pieces, for it is applicable to hard candy, chocolate or other candy pieces which may be shaped to assume any desired animal-like or humanoid form such as that of a baby, a boy or girl, a cat or a lion.

Container 10 and cap 12 screwed thereon is housed within the interior of a three-dimensional hollow figure molded of rigid synthetic plastic which has a shape similar to that of a miniature candy piece 13, but in a greatly enlarged scale.

Hence in this embodiment the figure is bear-like. This figure is constituted by a body section 14 and a complimentary head section 15. Body section 14 has a flat bottom wall 15, the front wall of this section being molded to define stylized front paws 17 and 18, and rear paws 19 and 20 of the bear. The rear of the body section is molded to define a tail T. The head section is molded to define ears 21 and 22, eyes 23 and 24, and the muzzle 25 of the bear.

The internal cavity 26 of body section 14 communicates with a circular top side opening 27 and a front side viewing port 28 at the belly of the bear. Cylindrical container 10 is seated within body section 14, the bottom of the container being bonded by adhesive to the bottom wall 16 of this section. The height of container 10 is such that its neck 11 projects out of top side opening 27. The girth of body section is substantially greater than the diameter of container 10, so that the space between the container and the side wall of the body section is unoccupied.

However one viewing the package can see candy pieces 13 stored in container 10 through port 28 in the belly of the bear, but not the entire container 10. Hence the viewer gains the impression that the entire figure of the package is filled with candy pieces, for there is nothing to tell him that it is only the container that is loaded.

Head section 15 has an internal cavity 29 that communicates with a circular bottom opening 30 within which is nested screw-on cap 12, the cap being bonded by adhesive to this opening, so that the cap is integrated with the head section. Hence by turning head section 15, one then turns the cap which can be screwed onto the neck of 11 of the container, thereby both sealing the container and completing the figure. To remove candy pieces from the container, one must detach the head section from the body section.

The preferred method for integrating the container and its screw-on cap with the body and head sections of the package is to first load the candy pieces into container 10 and then screw on cap 11 to seal the loaded container so that no contaminants may be admitted into the container. This is best carried out in a "clean room" under sterile conditions.

Once the loaded container is capped and sealed, its integration with the head and body section may be carried out under ordinary factory conditions. All that is now necessary is to first apply an adhesive coating to the bottom of container 10. The capped container is then seated within cavity 26 of the body section so that the bottom of the container rests on the bottom wall 16 of the section and becomes adhesively bonded thereto.

Cap 11 which is screwed onto neck 11 of the container and projects above top opening 27 is then coated with adhesive, and head section 15 is then fitted over this cap so that the cap is socketed within bottom opening 30 of the head section and becomes adhesively bonded thereto.

When the adhesive dries and solidifies, the container is fixed within the body section and the cap is fixed within the head section, and the display figure is now complete to provide the desired display package which may be displayed and merchandised in this state.

The potential purchaser of the display package is attracted by the stylized figure of a bear as he would be to a teddy bear. And he sees through the port that the candy pieces stored in the figure have a similar form, but in a miniature scale. Thus the display package is highly effective, for the appeal of the bear-like display figure is heightened by the appeal of the miniature multi-colored, bear-like candy pieces exposed through the belly port, giving the impression that the big bear has been fattened by the miniature candy bears.

It is not essential to the invention that the form of the display figure match that of the candy pieces, for in practice candy pieces of any shape may be loaded into the container.

When the container is depleted of candy pieces, the user need not discard the package, for its appeal survives the candy pieces that had been stored therein, and the user may continue to use the package as a decorative object and also to store small toy or other pieces in the container.

And if the package is used to store candy pieces whose shape is not that of a miniature bear but of another figurative shape, then the plastic display figure will be molded to assume a shape corresponding to that of the candy pieces.

The molded plastic figure lends itself to decorative accessories appropriate to different occasions or themes. Thus as shown in FIG. 5, one may attach a small molded plastic cowboy hat onto the head section 15 of the bear-like figure, and identify this display figure a cowboy bear. Or one can attach a plastic baseball cap 32 to the head section and call the display figure a baseball bear. A beach bear is created as shown in FIG. 7 by placing simulated sun glasses over the eyes of the head section, while a Halloween bear is created by placing a conical hat 34 on the head of the figure.

But however the figure is decorated or adorned, one obtains access to the candy pieces stored therein by unscrewing the head section and thereby detaching the screw-on cap from the container loaded with these pieces.

While there has been shown preferred embodiments of the invention, it will be appreciated that many changes may be made thereon without departing from the spirit of the invention.

I claim:

1. A display package for storing and displaying small candy pieces, said package comprising:

A. a transparent cylindrical container having an externally threaded neck, said container being loaded with said candy pieces;

B. a screw-on cap received on said neck to seal said container;

C. a hollow three-dimensional figure molded of synthetic plastic material having a humanoid or animal-like shape, said figure being defined by a body section forming a torso and appendages of the figure whose cavity communicates with a top side opening, and a complementary head section forming the shaped head of the figure whose cavity communicates with a bottom opening, said container being fixedly seated within the cavity of the body section with its neck projecting above said top side opening; said cap being fixedly socketed within the bottom opening of the head section whereby the figure is completed when the cap is screwed onto the neck, access to the candy pieces being had when the head section is detached from the body section, the cavity of the body section having a front side viewing port therein which exposes the candy pieces stored in the transparent container, said body section having a substantially larger girth than said cylindrical container to give the impression that the entire figure is loaded with candy pieces, not just the container.

2. A package as set forth in claim 1, in which the container is formed of transparent synthetic plastic material.

3. A package as set forth in claim 1, in which the body section has a flat bottom wall and the container has a flat bottom which rests on the bottom wall and is adhered thereto.

4. A package as set forth in claim 1, in which the cap is adhered to the bottom opening of the head section.

5. A package as set forth in claim 1, in which the candy pieces have a shape similar to that of the figure.

6. A package as set forth in claim 5, in which the candy pieces have the shape of a miniature bear and the display figure has a similar shape but in a much greater scale.

7. A package as set forth in claim 6, in which the candy pieces are formed of molded jelly.

8. A package as set forth in claim 6, in which the candy pieces are molded into the shape of a miniature bear.

9. A package as set forth in claim 8, in which the figure has a corresponding shape in a much large scale.

* * * * *